US011694665B2

(12) United States Patent
Oba et al.

(10) Patent No.: US 11,694,665 B2
(45) Date of Patent: Jul. 4, 2023

(54) SOUND SOURCE, KEYBOARD MUSICAL INSTRUMENT, AND METHOD FOR GENERATING SOUND SIGNAL

(71) Applicant: YAMAHA CORPORATION, Hamamatsu (JP)

(72) Inventors: Yasuhiko Oba, Hamamatsu (JP); Akihiko Komatsu, Hamamatsu (JP); Michiko Tanoue, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 152 days.

(21) Appl. No.: 16/845,325

(22) Filed: Apr. 10, 2020

(65) Prior Publication Data

US 2020/0243057 A1 Jul. 30, 2020

Related U.S. Application Data

(63) Continuation of application No. PCT/JP2017/040061, filed on Nov. 7, 2017.

(51) Int. Cl.
*G10H 1/34* (2006.01)
*G10H 1/00* (2006.01)

(52) U.S. Cl.
CPC ..... *G10H 1/346* (2013.01); *G10H 1/0016* (2013.01); *G10H 2220/271* (2013.01); *G10H 2220/305* (2013.01)

(58) Field of Classification Search
CPC ..... G10H 1/346; G10H 1/0016; G10H 2220/271; G10H 2220/305
See application file for complete search history.

(56) References Cited

U.S. PATENT DOCUMENTS 7,429,699 B2 * 9/2008 Tajika ..... G10H 1/346 84/622
2005/0145104 A1 7/2005 Sasaki
(Continued)

FOREIGN PATENT DOCUMENTS

JP H0266597 A 3/1990
JP H11175065 A 7/1999
(Continued)

OTHER PUBLICATIONS

International Search Report issued in Intl. Appln. No. PCT/JP2017/040061 dated Jan. 30, 2018. English translation provided.
(Continued)

*Primary Examiner* — Jianchun Qin
(74) *Attorney, Agent, or Firm* — Rossi, Kimms & McDowell LLP

(57) ABSTRACT

A sound source includes: a processor that implements instructions to execute a plurality of tasks, including: a first calculating task that calculates a first estimated value based on a detection result yielded by a detecting device that detects passage of a key through a first, a second, and a third positions, the first estimated value pertaining to behavior of the key at a predetermined position; a second calculating task that calculates a second estimated value based on the result, the second estimated value pertaining to behavior of the key at a fourth position; a signal generating task that generates a first and a second sound signals; a first adjusting task that adjusts an output level of the first sound signal based on the first estimated value; and a second adjusting task that adjusts an output level of the second sound signal based on the second estimated value.

19 Claims, 7 Drawing Sheets

(56) References Cited

U.S. PATENT DOCUMENTS

| | | | | |
|---|---|---|---|---|
| 2011/0239846 | A1* | 10/2011 | Shimoda | G10H 1/344 84/687 |
| 2016/0042728 | A1 | 2/2016 | Ikeda | |

FOREIGN PATENT DOCUMENTS

| | | | |
|---|---|---|---|
| JP | 2005208570 | A | 8/2005 |
| JP | 2014059534 | A | 4/2014 |
| JP | 5664185 | B2 | 2/2015 |

OTHER PUBLICATIONS

Written Opinion issued in Intl. Appln No. PCT/JP2017/040061 dated Jan. 30, 2018.
Office Action issued in DE Appln. No. 112017008063.0 dated Mar. 14, 2023. English translation provided.
Office Action issued in Chinese Appln. No. 201780096436.7 dated Feb. 17, 2023. English translation provided.

* cited by examiner

SOUND SOURCE, KEYBOARD MUSICAL INSTRUMENT, AND METHOD FOR GENERATING SOUND SIGNAL

CROSS-REFERENCE TO RELATED APPLICATIONS

This application is a U.S. continuation application filed under 35 U.S.C. § 111(a), of International Application No. PCT/JP2017/040061, filed on Nov. 7, 2017, the disclosures of which are incorporated by reference.

FIELD

The present invention relates to a technology for generating a sound signal in a keyboard musical instrument.

BACKGROUND

Various devices have been designed to make sounds from electronic pianos as close as possible to sounds of acoustic pianos. When a key is depressed in playing an acoustic piano, not only is a string striking sound produced, but also a keybed hitting sound is produced along with the depression of the key. In the field of electronic musical instruments such as electronic pianos, PTL 1 (Japanese Patent Application Laid-Open No. 2014-59534) discloses a technology for reproducing such a keybed hitting sound.

SUMMARY

According to an embodiment of the present invention, there is provided a sound source including: a memory storing instructions; and a processor that implements the instructions to execute a plurality of tasks, including: a first calculating task that calculates a first estimated value based on a detection result yielded by a detecting device that detects passage of a key through a first position, a second position, and a third position within a range of depression of the key, the first estimated value pertaining to behavior of the key at a predetermined position within the range of depression, the second position being deeper than the first position, the third position being deeper than the second position; a second calculating task that calculates a second estimated value based on the detection result, the second estimated value pertaining to behavior of the key at a fourth position that is deeper than the third position; a signal generating task that generates a first sound signal and a second sound signal based on the detection result; a first adjusting task that adjusts an output level of the first sound signal based on the first estimated value; and a second adjusting task that adjusts an output level of the second sound signal based on the second estimated value.

According to an embodiment of the present invention, there is provided a method for generating sound signal including: calculating a first estimated value based on a detection result yielded by a detecting device that detects passage of a key through a first position, a second position, and a third position within a range of depression of the key, the first estimated value pertaining to behavior of the key at a predetermined position within the range of depression, the second position being deeper than the first position, the third position being deeper than the second position; calculating a second estimated value based on the detection result, the second estimated value pertaining to behavior of the key at a fourth position that is deeper than the third position; setting an amplification factor of a first sound signal based on the first estimated value and an amplification factor of a second sound signal based on the second estimated value; and outputting a signal for starting generation of the first and second sound signals that are to be amplified.

DESCRIPTION OF EMBODIMENTS

Figure 1:
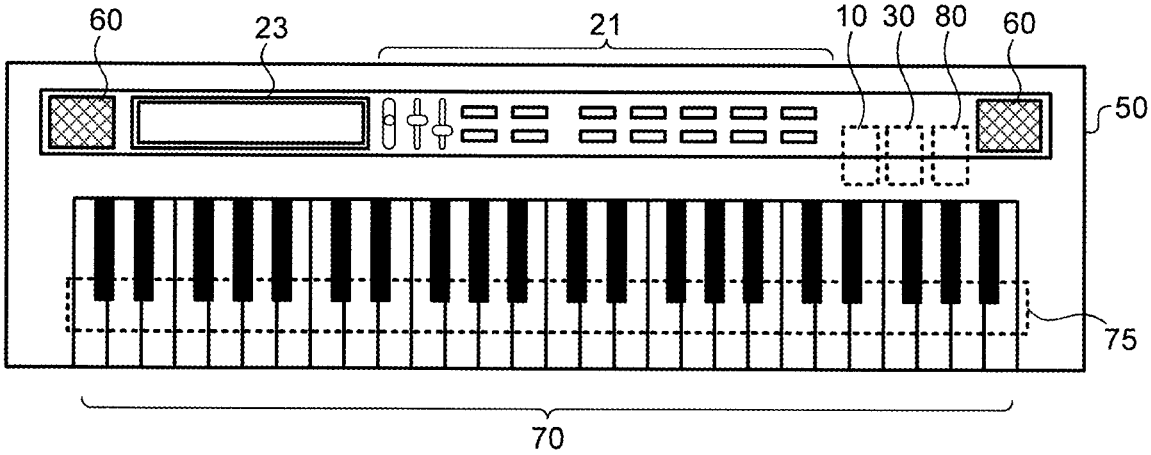
FIG. 1 is a diagram showing a configuration of an electronic keyboard musical instrument according to an embodiment of the present invention.

In the following, an electronic keyboard musical instrument according to an embodiment of the present invention is described in detail with reference to the drawings. Embodiments to be described below are examples of embodiments of the present invention, and the present invention is not construed within the limitations of these embodiments. It should be noted that in the drawings that are referred to in the present embodiment, identical parts or parts having the same functions are given identical signs or similar signs (signs each formed simply by adding A, B, or the like to the end of a number) and a repeated description thereof may be omitted.

EMBODIMENT

[1. Configuration of Keyboard Musical Instrument]

FIG. 1 is a diagram showing a configuration of an electronic keyboard musical instrument according to an embodiment of the present invention. An electronic keyboard musical instrument 1 is for example an electronic piano, and is an example of a keyboard musical instrument having a plurality of keys 70 as playing operators. A user's operation of a key 70 causes a sound to be produced from a speaker 60. Types of sound (timbres) to be produced vary through the use of an operating unit 21. In this example, in producing sounds through the use of the timbre of a piano, the electronic keyboard musical instrument 1 can produce sounds which are close to those of an acoustic piano. In particular, the electronic keyboard musical instrument 1 can reproduce sounds of a piano in which keybed hitting sounds are contained.

Such a string striking sound and a keybed hitting sound as those mentioned above are produced by different sound-producing mechanisms. According to the technology disclosed in PTL 1, distinct sound signals are generated for a string striking sound and a keybed hitting sound in consideration of the difference between the sound-producing mechanisms; however, there has been a case where a player has a sense of incompatibility, depending on operations of keys.

The present invention makes it possible to make a sound signal that is equivalent to a keybed hitting sound reflecting an operation of a key closer to a keybed hitting sound of an acoustic piano. The following describes each component of the electronic keyboard musical instrument 1 in detail.

The electronic keyboard musical instrument 1 includes the plurality of key 70. The plurality of keys 70 are rotatably supported by a housing 50. The housing 50 is provided with the operating unit 21, a display unit 23, and the speaker 60. The housing 50 has disposed therein a control unit 10, a storage unit 30, a key position detecting unit 75, and a sound source 80. The components disposed in the housing 50 are connected to each other via a bus.

In this example, the electronic keyboard musical instrument 1 includes an interface though which signals are inputted and outputted to and from an external device. Examples of the interface include a terminal through which a sound signal is outputted to the external device, a cable connection terminal through which MIDI data is transmitted and received, and the like.

The control unit 10 includes an arithmetic processing circuit such as a CPU and a storage device such as a RAM or a ROM. The control unit 10 executes, through the CPU, a control program stored in the storage unit 30 and thereby allows the electronic keyboard musical instrument 1 to achieve various types of functions. The operating unit 21 includes devices such as operation buttons, a touch sensor, sliders and outputs, to the control unit 10, a signal corresponding to an operation inputted. The display unit 23 displays a screen based on control exercised by the control unit 10.

The storage unit 30 is a storage device such as a non-volatile memory. The storage unit 30 has stored therein the control program that is executed by the control unit 10. Further, the storage unit 30 may have stored therein parameters, waveform data, and the like that are used in the sound source 80. The speaker 60 amplifies and outputs a sound signal that is outputted from the control unit 10 or the sound source 80 and thereby produces a sound corresponding to the sound signal.

The key position detecting unit 75 includes a plurality of sensors (in this example, three sensors) disposed for each of the plurality of keys 70. The plurality of sensors are disposed in different positions, respectively, within in a range of depression (from a rest position to an end position) of the key 70 and, upon detection of passage of the key 70, output a detection signal. This detection signal contains a first detection signal KP1, a second detection signal KP2, and a third detection signal KP3, which will be described below. At this point in time, containing information (e.g. a key number KC) indicating a key 70 makes it possible to identify a key 70 that has been depressed. In this way, signals that key position detecting unit 75 outputs represent detection results indicating passage of each of the keys 70 through the positions. Details will be described later.

[2. Configuration of Key Assembly]

Figure 2:
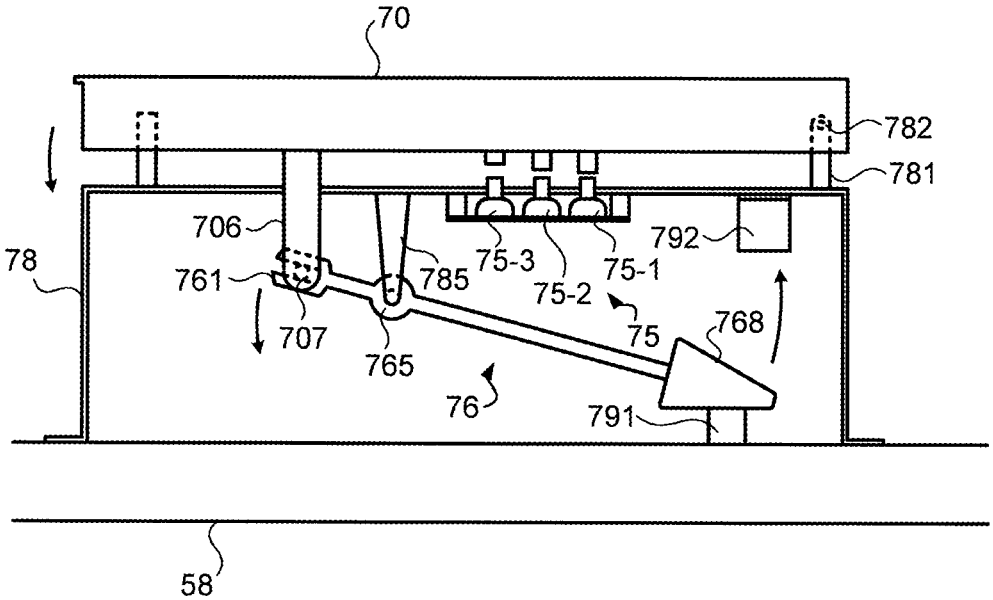
FIG. 2 is a diagram showing a mechanical structure (key assembly) linked with a key according to the embodiment of the present invention.

FIG. 2 is a diagram showing a mechanical structure (key assembly) linked with a key according to the embodiment of the present invention. FIG. 2 gives a description by taking as an example a structure associated with a white key of the keys 70. A keybed 58 is a member that constitutes a part of the aforementioned housing 50. To the keybed 58, a frame 78 is fixed. On top of the frame 78, a key supporting member 781 projecting upward from the frame 78 is disposed. The key supporting member 781 supports the key 70 so that the key 70 can rotate on a spindle 782. A hammer supporting member 785 projecting downward from the frame 78 is disposed. A hammer 76 is disposed on a side of the frame 78 opposite to the key 70. The hammer supporting member 785 supports the hammer 76 so that the hammer 76 can rotate on a spindle 765.

A hammer connecting part 706 projecting toward a lower position than the key 70 includes a coupling part 707 at a lower end thereof. The key connecting part 761 and the coupling part 707, which are disposed at one end of the hammer 76, are slidably connected to each other. The hammer 76 includes a weight 768 (second member) on a side of the spindle 765 opposite to the key connecting part 761. When the key 70 is not being operated, the weight 768 is placed on a lower limit stopper 791 by its own weight.

Meanwhile, depression of the key 70 causes the key connecting part 761 to move downward, and rotation of the hammer 76 causes the weight 768 to move upward. A collision of the weight 768 with an upper limit stopper 792 (first member) restricts the rotation of the hammer 76, so that the key 70 becomes unable to be depressed. A strong depression of the key 70 causes the hammer 76 (weight 768) to hit the upper limit stopper 792, and a hitting sound is produced at that time. This hitting sound may be transmitted to the keybed 58 via the frame 78 and emitted as a louder sound. In the configuration of FIG. 2, this sound is equivalent to a keybed hitting sound. It should be noted that the key assembly is not limited to the structure shown in FIG. 2. The key assembly may be a structure in which no hitting sound is produced or a structure in which a hitting sound is hardly produced.

A first sensor 75-1, a second sensor 75-2, and a third sensor 75-3 are disposed between the frame 78 and the key 70. The first sensor 75-1, the second sensor 75-2, and the third sensor 75-3 correspond to the plurality of sensors of the aforementioned key position detecting unit 75. Depressing the key 70 causes the first sensor 75-1 to output the first detection signal KP1 when the key 70 has passed through a first position P1 (when the key 70 has been depressed to a lower position than the first position P1). Then, the second sensor 75-2 outputs the second detection signal KP2 when the key 70 has passed through a second position P2 (when the key 70 has been depressed to a lower position than the second position P2). Furthermore, the third sensor 75-3 outputs the third detection signal KP3 when the key 70 has passed through a third position P3 (when the key 70 has been depressed to a lower position than the third position P3). Meanwhile, when the key 70 that has been depressed returns to its original position (rest position), the third detection signal KP3, the second detection signal KP2, and the first detection signal KP1 sequentially stop being outputted.

Figure 3:
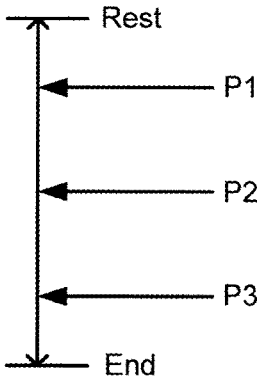
FIG. 3 is a diagram explaining positions of a key that are detected by sensors according to the embodiment of the present invention.

FIG. 3 is a diagram explaining positions of a key that are detected by sensors according to the embodiment of the present invention. As shown in FIG. 3, the first position P1, the second position P2, and the third position P3 are predetermined positions between the rest position (Rest) and the end position (End). The rest position is a position where the key 70 has not been depressed, and the end position is a position where the key 70 has been completely depressed. Depressing the key 70 causes the key 70 to pass through the first position P1, the second position P2, and the third position P3 in this order. Although, in this example, the first position P1, the second position P2, and the third position P3 are set so that the distance between the first position P1 and the second position P2 and the distance between the second position P2 and the third position P3 are equal to each other, this is not intended to impose any limitation. That is, the first position P1, the second position P2, and the third position P3 may be disposed in any way, provided the first position P1, the second position P2, and the third position P3 are arranged in this order from the rest position toward the end position. In other words, the second position P2 is a deeper position than the first position P1, and the third position P3 is a deeper position than the second position P2. Further, the end position is the deepest position in the range (range of depression) within which the key 70 can move.

The description goes on with continued reference to FIG. 1. The sound source 80 generates a sound signal on the basis of a detection signal (a key number KC, a first detection signal KP1, a second detection signal KP2, and a third detection signal KP3) that is outputted from the key position detecting unit 75 and outputs the detection signal to the speaker 60. A sound signal that the sound source 80 generates is obtained for each operation on the key 70. Moreover, a plurality of sound signals obtained by a plurality of key depressions are combined and outputted from the sound source 80. The following describes a configuration of the sound source 80 in detail. It should be noted the functional configuration of the sound source 80 to be described below may be realized by hardware or may be realized by software. In the latter case, the functional configuration of the sound source 80 may be realized by executing, through the CPU, a program stored in a memory or the like. Further, a portion of the functional configuration of the sound source 80 may be realized by software, and the remaining portion may be realized by hardware.

[3. Configuration of Sound Source]

Figure 4:
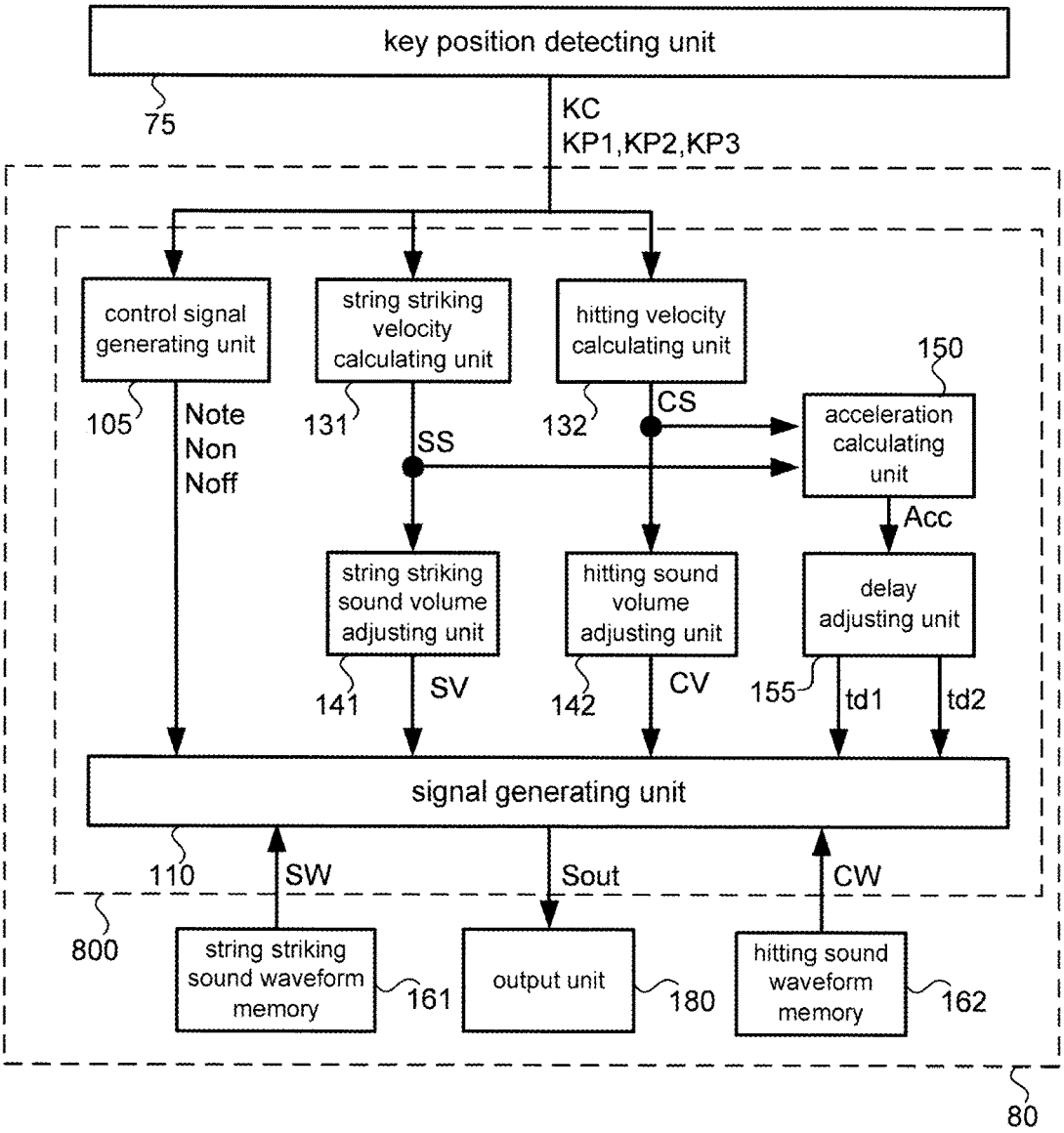
FIG. 4 is a block diagram explaining a functional configuration of a sound source according to the embodiment of the present invention.

FIG. 4 is a block diagram explaining a functional configuration of a sound source according to the embodiment of the present invention. The sound source 80 includes a sound signal generating unit 800, a string striking sound waveform memory 161, a hitting sound waveform memory 162, and an output unit 180. The sound signal generating unit 800 outputs a sound signal Sout to the output unit 180 on the basis of the key number KC, the first detection signal KP1, the second detection signal KP2, and the third detection signal KP3 that are outputted from the key position detecting unit 75. At this point in time, the sound signal generating unit 800 reads out string striking sound waveform data SW from the string striking sound waveform memory 161 and reads out hitting sound waveform data CW from the hitting sound waveform memory 162. The output unit 180 outputs the sound signal Sout to the speaker 60.

The string striking sound waveform memory 161 has stored therein waveform data representing string striking sounds of a piano. This waveform data corresponds to the aforementioned string striking sound waveform data SW, and is waveform data obtained by sampling sounds of an acoustic piano (i.e. sounds produced by string striking entailed by key depression). In this example, waveform data of different pitches are stored in association with note numbers. The string striking sound waveform data SW is waveform data at least a portion of which is read out in a loop when the string striking sound waveform data SW is read out by the after-mentioned waveform readout unit 111.

The hitting sound waveform memory 162 has stored therein waveform data representing keybed hitting sounds of a piano. This waveform data corresponds to the aforementioned hitting sound waveform data CW, and is waveform data obtained by sampling keybed hitting sounds entailed by depression of keys of an acoustic piano. Unlike the string striking waveform memory 161, which has waveform data stored therein, the hitting sound waveform memory 162 does not have stored therein waveform data whose pitches vary according to note number. That is, the hitting sound waveform memory 162 has common waveform data stored therein regardless of note number. The hitting sound waveform data CW is waveform data whose readout is finished once the hitting sound waveform data CW is read out to the end by the after-mentioned waveform readout unit 121. In this point, too, the hitting sound waveform data CW is different from the string striking sound waveform data SW.

Figure 5:
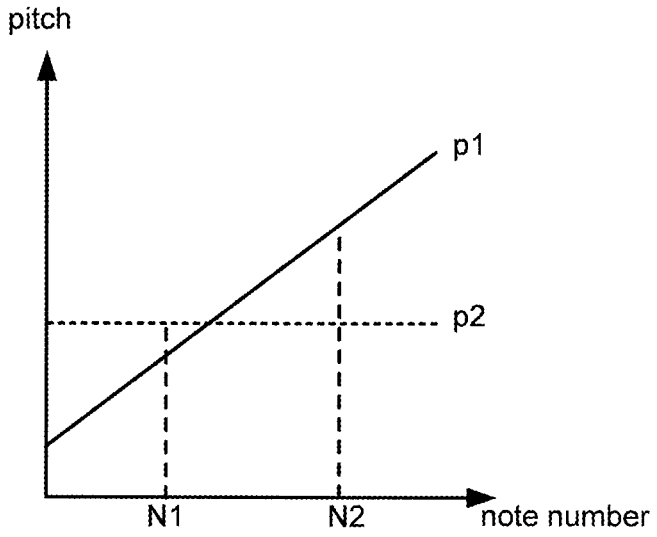
FIG. 5 is a diagram explaining a relationship between the pitches of a string striking sound and a hitting sound with respect to note numbers according to the embodiment of the present invention.

FIG. 5 is a diagram explaining a relationship between the pitches of a string striking sound and a hitting sound with respect to note numbers according to the embodiment of the present invention. FIG. 5 shows a relationship between the note number Note and the pitch. FIG. 5 shows the pitch p1 of a string striking sound and the pitch p2 of a hitting sound in contrast with each other. A change in the note number Note leads to a change in the pitch p1 of a string striking sound. On the other hand, even a change in the note number Note does not lead to a change in the pitch p2 of a hitting sound. In other words, the pitch p1 of a string striking sound varies from a case where the note number Note is N1 to a case where the note number Note is N2. On the other hand, the pitch p2 of a hitting sound remains the same in both a case where the note number Note is N1 and a case where the note number Note is N2. It should be noted that the pitch p1 of a string striking sound and the pitch p2 of a hitting sound as shown in FIG. 5 indicate their respective trends of change with respect to the note number Note and do not indicate a magnitude relationship between them.

[3-1. Configuration of Sound Signal Generating Unit]

The description goes on with continued reference to FIG. 4. The sound signal generating unit 800 includes a control signal generating unit 105, a signal generating unit 110, a string striking velocity calculating unit 131, a hitting velocity calculating unit 132, a string striking sound volume adjusting unit 141, a hitting sound volume adjusting unit 142, an acceleration calculating unit 150, and a delay adjusting unit 155. The signal generating unit 110 generates a signal representing a string striking sound (such a signal being hereinafter referred to as "string striking sound signal (first sound signal)") and a signal representing a keybed hitting sound (such a signal being hereinafter referred to as "hitting sound signal (second sound signal)") on the basis of parameters that are outputted from the control signal generating unit 105, the string striking sound volume adjusting unit 141, the hitting sound volume adjusting unit 142, and the delay adjusting unit 155 and outputs the signals.

[3-2. Control Signal Generation]

The control signal generating unit 105 generates, on the basis of a detection signal that is outputted from the key position detecting unit 75, a control signal that defines a content of sound production. In this example, this control signal is MIDI-format data, generates a note number Note, a note-on Non, and a note-off Noff, and outputs them to the signal generating unit 110. Upon output of the third detection signal KP3 from the key position detecting unit 75, the control signal generating unit 105 generates and outputs a note-on Non. That is, when the key 70 has been depressed and has passed through the third position P3, a note-on Non is outputted. A target note number Note is determined on the basis of a key number KC outputted in association with the third detection signal KP3.

Meanwhile, the control signal generating unit 105 generates and outputs a note-off Noff when the output of the first detection signal KP1 of the corresponding key number KC is stopped after a note-on Non has been generated. That is, when a depressed key 70 passes through the first position P1 in returning to the rest position, a note-off Noff is generated.

[3-3. Estimated Velocity Calculation]

The string striking velocity calculating unit 131 (first calculating unit) calculates, on the basis of a detection signal that is outputted from the key position detecting unit 75, an estimated value (first estimate value) of the velocity of a depressed key 70 at a predetermined position. This estimated value is hereinafter referred to as "string striking estimated velocity SS". In this example, the string striking velocity calculating unit 131 calculates the string striking estimated velocity SS according to a predetermined operation involving the use of a first period of time from passage of the key 70 through the first position P1 to passage of the key 70 through the second position P2. It is assumed here that the string striking estimated velocity SS is a value obtained by multiplying the reciprocal of the first period of time by a predetermined constant. It should be noted that the string striking estimated velocity SS is a value calculated by estimating the velocity at which the hammer hits the string.

The hitting velocity calculating unit 132 (second calculating unit) calculates, on the basis of a detection signal that is outputted from the key position detecting unit 75, an estimated value (second estimated value) of the velocity of a depressed key 70 at the end position (fourth position). This estimated value is hereinafter referred to as "hitting estimated velocity CS". In this example, the hitting velocity calculating unit 132 calculates the hitting estimated velocity CS according to a predetermined operation involving the first period of time and a second period of time from passage of the key 70 through the second position P2 to passage of the key 70 through the third position P3. The hitting estimated velocity CS here is obtained by calculating, from the change of the second period of time from the first period of time, a change in velocity entailed by a change in position of the key 70 and estimating the velocity of the key 70 at the end position, i.e. the velocity of the key 70 producing a keybed hitting sound.

Figure 6:
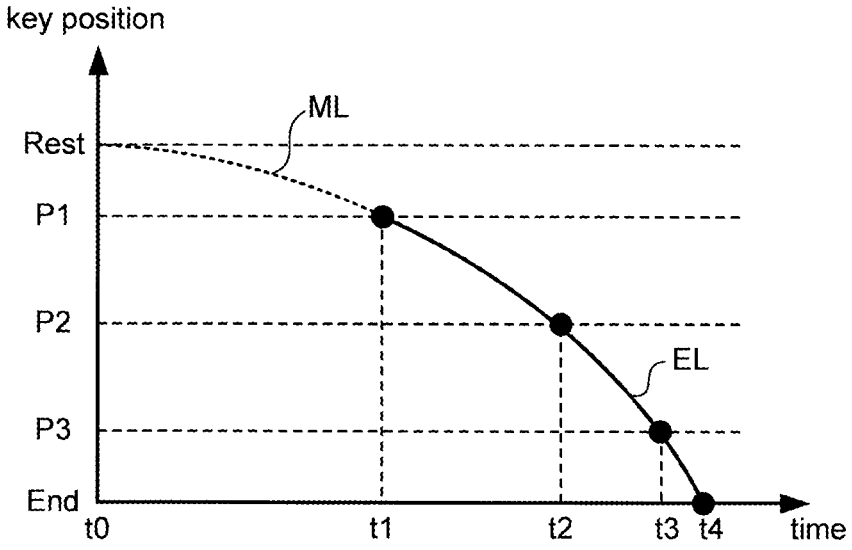
FIG. 6 is a diagram explaining an example of a method for calculating the velocity of a key at an end position according to the embodiment of the present invention.

FIG. 6 is a diagram explaining an example of a method for calculating the velocity of a key at an end position according to the embodiment of the present invention. FIG. 6 is a diagram whose horizontal axis represents time and whose vertical axis represents the positions of a key 70 (from the rest position to the end position). The locus ML (dotted line) indicates a relationship between periods of time having elapsed from a point of time t0 since the key 70 was actually depressed and the positions of the key 70. It is assumed here that the key 70 reaches the end position at a point of time t4.

The locus ML of FIG. 6 shows that the first detection signal KP1 is outputted at a point of time t1, that the second detection signal KP2 is outputted at a point of time t2, and that the third detection signal KP3 is outputted at a point of time t3. Such points of time t1, t2, and t3 are each recorded in a memory or the like for each note number Note. The first period of time corresponds to "t2−t1". The second period of time corresponds to "t3−t2". The hitting velocity calculating unit 132 recognizes passage of the key 70 through the first position P1 at the point of time t1, passage of the key 70 through the second position P2 at the point of time t2, and passage of the key 70 through the third position P3 at the point of time t3. By calculating an estimated locus EL (solid line) from these relationships, the hitting velocity calculating unit 132 calculates the point of time t4, at which the key 70 reaches the end position, and the velocity at which the key 70 moves at the point of time t4.

[3-4. Sound Volume Adjustment]

The description goes on with continued reference to FIG. 4. The string striking sound volume adjusting unit 141 (first adjusting unit) determines a string striking sound volume designated value SV on the basis of the string striking estimated velocity SS. The string striking sound volume designated value SV is a value for designating the sound volume of a string striking sound signal that the signal generating unit 110 generates. In this example, the higher the string striking estimated velocity SS is, the higher the string striking sound volume designated value SV becomes.

The hitting sound volume adjusting unit 142 (second adjusting unit) determines a hitting sound volume designated value CV on the basis of the hitting estimated velocity CS. The hitting sound volume designated value CV is a value for designating the sound volume of a hitting sound signal that the signal generating unit 110 generates. In this example, the higher the hitting estimated velocity CS is, the higher the hitting sound volume designated value CV becomes.

[3-5. Delay Adjustment]

The acceleration calculating unit 150 calculates an amount of change (hereinafter referred to as "acceleration of depression Acc) between the string striking estimated velocity SS and the hitting estimated velocity CS. This acceleration of depression Acc may be calculated on the basis of a change between the first period of time and the second period of time. The delay adjusting unit 155 determines a string striking sound delay time td1 on the basis of the acceleration of depression Acc with reference to a string striking sound delay table. Further, the delay adjusting unit 155 determines a hitting sound delay time td2 on the basis of the acceleration of depression Acc with reference to a hitting sound delay table. The string striking sound delay time td1 represents a delay time from a note-on Non to outputting of a string striking sound signal. The hitting sound delay time td2 represents a delay time from a note-on Non to outputting of a hitting sound signal.

Figure 7:
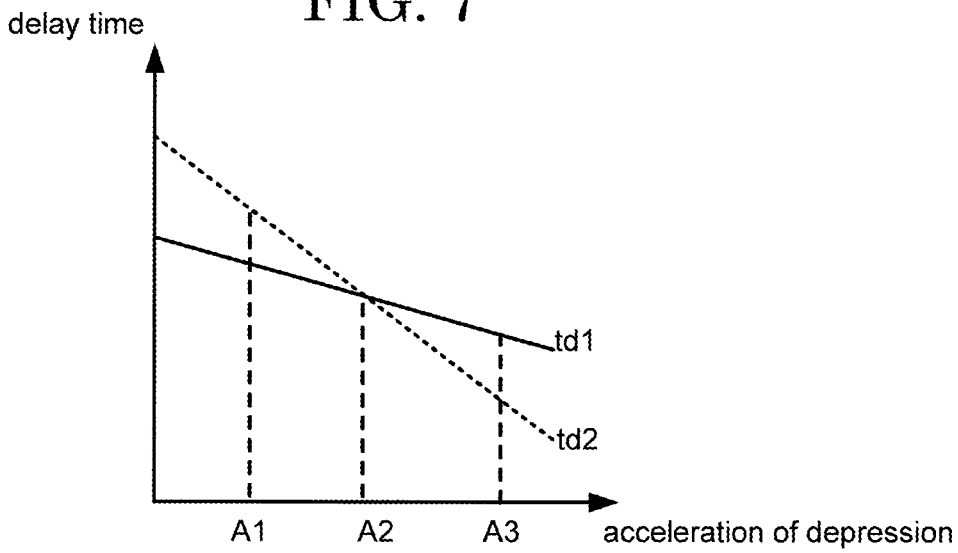
FIG. 7 is a diagram explaining a string striking sound delay table and a hitting sound delay table according to the embodiment of the present invention.

FIG. 7 is a diagram explaining a string striking sound delay table and a hitting sound delay table according to the embodiment of the present invention. Both tables define a relationship between the acceleration of depression Acc and a delay time. FIG. 7 shows the string striking sound delay table and the hitting sound delay table in contrast with each other. The string striking sound delay table defines a relationship between the acceleration of depression Acc and the string striking sound delay time td1. The hitting sound delay table defines a relationship between the acceleration of depression Acc and the hitting sound delay time td2. In either table, the higher the acceleration of depression Acc becomes, the shorter the delay time becomes.

In this example, when the acceleration of depression Acc is A2, the string striking sound delay time td1 and the hitting sound delay time td2 become equal to each other. When the acceleration of depression Acc is A1, which is smaller than A2, the hitting sound delay time td2 becomes a longer time than the string striking sound delay time td1. On the other hand, when the acceleration of depression Acc is A3, which is larger than A2, the hitting sound delay time td2 becomes a shorter time than the string striking sound delay time td1. At this point in time, A2 may be "0". In this case, A1 takes on a negative value and indicates gradual deceleration during depression. On the other hand, A3 takes on a positive value and indicates gradual acceleration during depression.

It should be noted that although, in the example shown in FIG. 7, the acceleration of depression Acc and the delay time are defined by a relationship that can be expressed by a linear function, any relationship will do, provided it is such a relationship that the delay time can be determined with respect to the acceleration of depression Acc. Further, the delay time may be determined by using another parameter instead of the acceleration of depression Acc or using a combination of a plurality of parameters.

Figure 8:
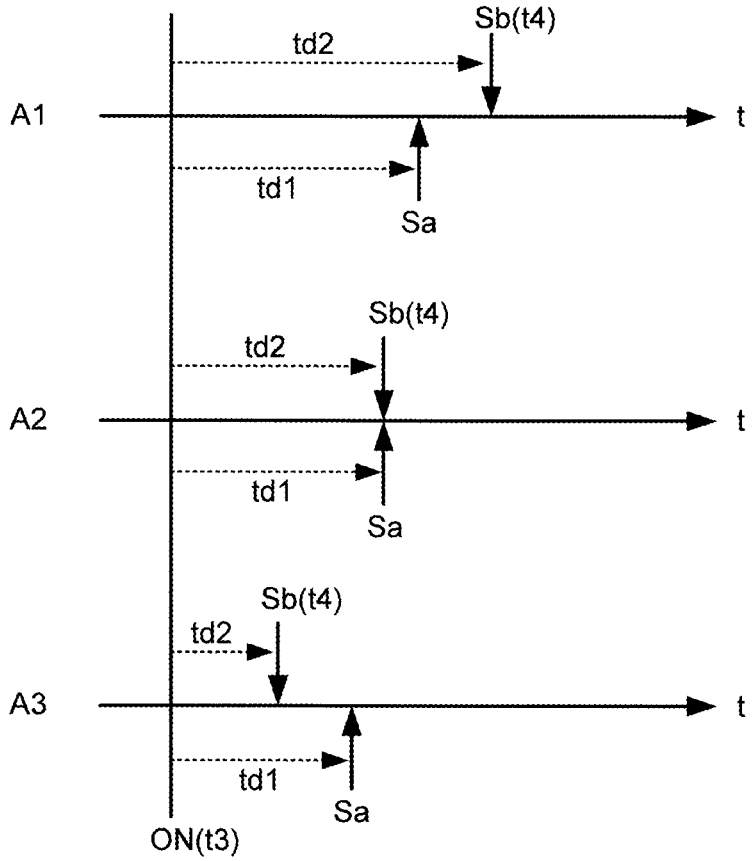
FIG. 8 is a diagram explaining timings of production of string striking sounds and hitting sounds with respect to note-on's according to the embodiment of the present invention.

FIG. 8 is a diagram explaining timings of production of string striking sounds and hitting sounds with respect to note-on's according to the embodiment of the present invention. A1, A2, and A3 in FIG. 8 correspond to values of the acceleration of depression Acc in FIG. 7. That is, the relationship among the accelerations of depression is defined as A1<A2<A3. A time signal is indicated along each horizontal axis. The sign "ON" denotes a timing of reception of an instruction signal representing a note-on Non. Accordingly, in the example of the locus shown in FIG. 6, the sign "ON" corresponds to the point of time t3.

The sign "Sa" denotes a timing of start of output of a string striking sound signal, and the sign "Sb" denotes a timing of start of output of a hitting sound signal. Accordingly, the string striking sound delay time td1 corresponds to the time from "ON" to "Sa". The hitting sound delay time td2 corresponds to the time from "ON" to "Sb". It should be noted that in the example of the locus shown in FIG. 6, the timing of outputting "Sb" of a hitting sound signal may correspond to the point of time t4. In this case, the hitting sound delay time td2 is equivalent to "t4−t3".

As shown in FIG. 8, the higher the acceleration of depression becomes, the less the timings of generation of both the string striking sound signal and the hitting sound signal lag behind the note-on Non. Furthermore, the hitting sound signal is larger in proportion of change in timing of generation than the string striking sound signal. Accordingly, a relative relationship between the timing of generation of the string striking sound signal and the timing of generation of the hitting sound signal changes according to the acceleration of depression.

[3-6. Signal Generating Unit]

Figure 9:
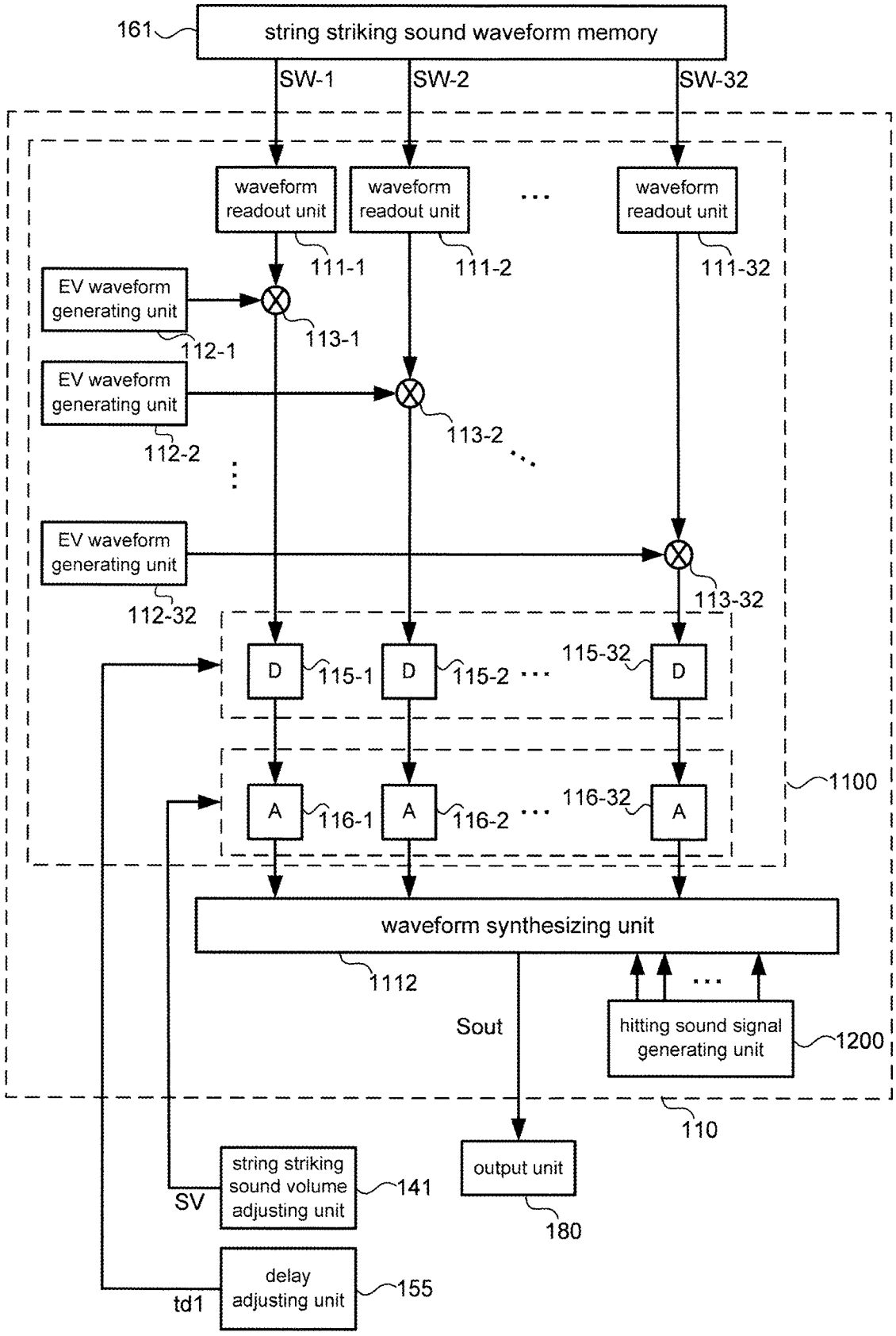
FIG. 9 is a block diagram explaining a functional configuration of a string striking sound signal generating unit of a signal generating unit according to the embodiment of the present invention.
Figure 10:
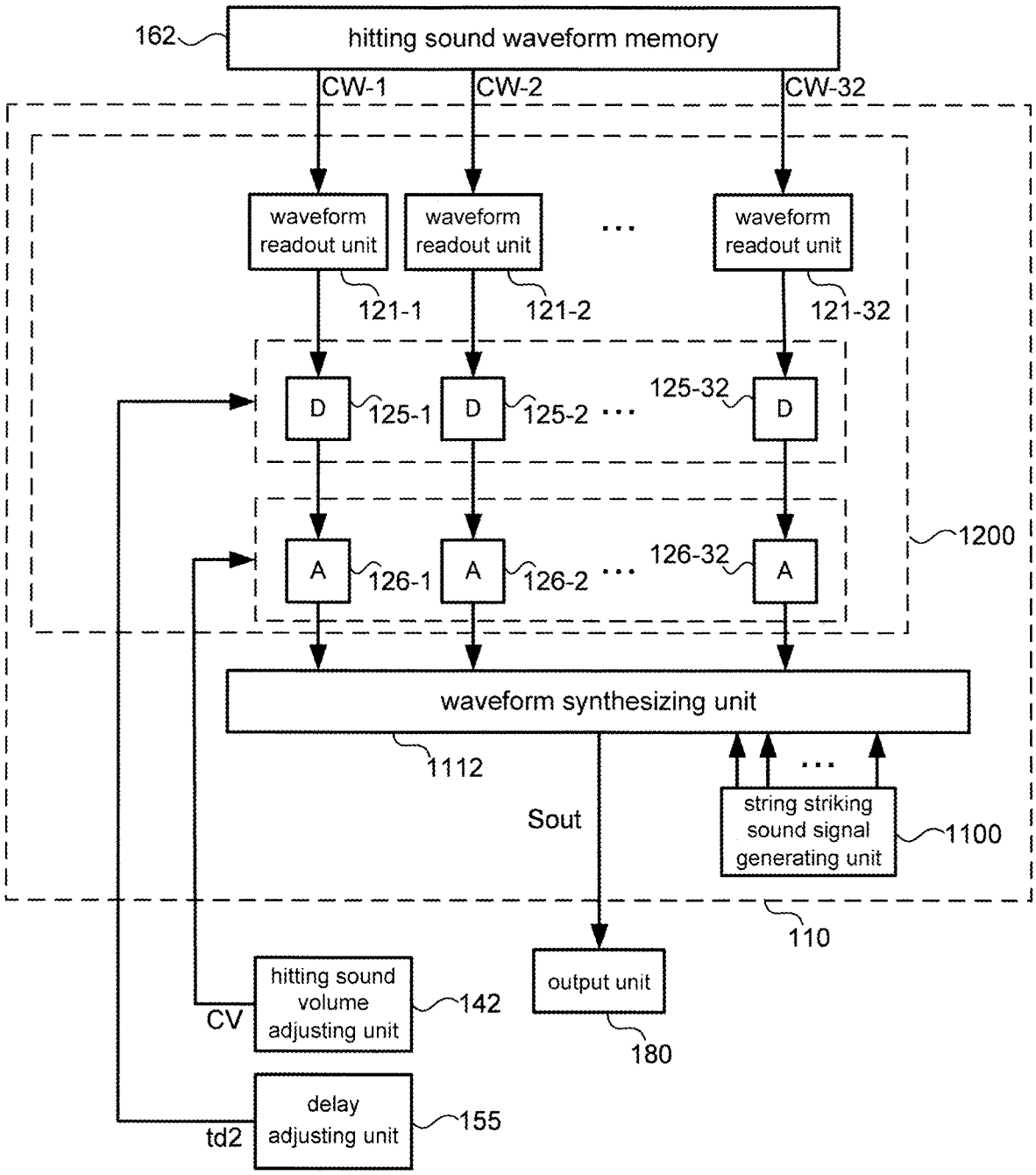
FIG. 10 is a block diagram explaining a functional configuration of a hitting sound signal generating unit of the signal generating unit according to the embodiment of the present invention.

The following describes a detailed structure of the signal generating unit 110 with reference to FIGS. 9 and 10. The signal generating unit 110 includes a string striking sound signal generating unit 1100, a hitting sound signal generating unit 1200, and a waveform synthesizing unit 1112. The string striking sound signal generating unit 1100 generates a string striking sound signal on the basis of a detection signal that is outputted from the key position detecting unit 75. The hitting sound signal generating unit 1200 generates a hitting sound signal on the basis of a detection signal that is outputted from the key position detecting unit 75. The waveform synthesizing unit 1112 combines a string striking sound signal that is generated by the string striking sound signal generating unit 1100 and a hitting sound signal that is generated by the hitting sound signal generating unit 1200 and outputs them as a sound signal Sout.

[3-6-1. String Striking Sound Signal Generating Unit]

FIG. 9 is a block diagram explaining a functional configuration of a string striking sound signal generating unit of a signal generating unit according to the embodiment of the present invention. The string striking sound signal generating unit 1100 includes waveform readout units 111 (waveform readout units **111-*k*; k=1 to n), EV (envelope) waveform readout units 112 (112-*k*; k=1 to n), multipliers 113 (113-*k*; k=1 to n), delay devices 115 (115-*k*; k=1 to n), and amplifiers 116 (116-*k*; k=1 to n). The sign "n" corresponds to the number of sounds that can be produced at the same time (i.e. the number of sound signals that can be generated at the same time) and, in the present embodiment, is 32. That is, the string striking sound signal generating unit 1100** maintains produced sounds until the 32nd key depression and, upon the 33rd key depression during production of all of the sounds, forcibly stops the sound signal corresponding to the first produced sound.

The waveform readout unit 111-1 selectively reads out, from the string striking sound waveform memory 161 in accordance with a control signal (e.g. a note-on Non) obtained from the control signal generating unit 105, string striking sound waveform data SW-1 to be read out and generates a sound signal of a pitch according to the note number Note. The waveform readout unit 111-1 continues to read out the string striking sound waveform data SW until the disappearance of the sound of a sound signal generated in correspondence with a note-off Noff.

The EV waveform generating unit 112-1 generates an envelope waveform in accordance with a control signal obtained from the control signal generating unit 105 and preset parameters. For example, the envelope waveform is defined by parameters such as an attack level AL, an attack time AT, a decay time DT, a sustain level SL, and a release time RT.

The multiplier 113-1 multiplies the sound signal generated by the waveform readout unit 111-1 by the envelope waveform generated by the EV waveform generating unit 112-1 and outputs the product to the delay device 115-1.

The delay device 115-1 delays the sound signal according to a set delay time and outputs the sound signal to the amplifier 116-1. This delay time is set on the basis of the delay time td1 determined by the delay adjusting unit 155. In this way, the delay adjusting unit 115 adjusts the timing of production of the sound of a string striking sound signal.

The amplifier 116-1 amplifies the sound signal according to a set amplification factor and outputs the sound signal to the waveform synthesizing unit 1112. This amplification factor is determined on the basis of the string striking sound volume estimated value SV determined by the string striking sound volume adjusting unit 141. Therefore, a string striking sound signal is generated so that the higher the string striking estimated velocity SS calculated according to the depression of a key 70 is, the higher the output level (sound volume) becomes. In this way, the string striking sound volume adjusting unit 141 adjusts the output level of a string striking sound signal on the basis of the string striking estimated velocity SS.

In the case illustrated, k=1 (k=1 to n), and every time the next key depression occurs during the readout of the string striking sound waveform data SW-1 from the waveform readout unit 111-1, control signals obtained from the control signal generating unit 105 are applied in the order of k=2, 3, 4, . . . . For example, with the next key depression, a control signal is applied to a configuration in which k=2, and a sound signal is outputted from the multiplier 113-2 in a manner similar to that described above. This sound signal is delayed by the delay device 115-2, amplified by the amplifier 116-2, and outputted to the waveform synthesizing unit 1112.

[3-6-2. Hitting Sound Signal Generating Unit]

FIG. 10 is a block diagram explaining a functional configuration of a hitting sound signal generating unit of the signal generating unit according to the embodiment of the present invention. The hitting sound signal generating unit 1200 includes waveform readout units 121 (waveform readout units **121-*j*; j=1 to m), delay devices 125 (125-*j*; j=1 to m), and amplifiers 126 (126-*j*; j=1 to m). The sign "m" corresponds to the number of sounds that can be produced at the same time (i.e. the number of sound signals that can be generated at the same time) and, in the present embodiment, is 32. The sign "m" here is equivalent to the sign "n" of the string striking sound signal generating unit 1100. That is, the hitting sound signal generating unit 1200** maintains produced sounds until the 32nd key depression and, upon the 33rd key depression during production of all of the sounds, forcibly stops the sound signal corresponding to the first produced sound. In most case, "m" may be less than "n" ("m<n"), as the readout of the hitting sound waveform data CW takes a shorter time to finish than the readout of the string striking sound waveform data SW.

The waveform readout unit 121-1 selectively reads out, from the hitting sound waveform memory 162 in accordance with a control signal (e.g. a note-on Non) obtained from the control signal generating unit 105, hitting sound waveform data CW-1 to be read out, generates a sound signal, and outputs the sound signal to the delay device 125-1. As mentioned above, once the waveform readout unit 121-1 reads out the hitting sound waveform data CW-1 to the end, the waveform readout unit 121-1 finishes the readout regardless of note-off Noff.

The delay device 125-1 delays the sound signal according to a set delay time and outputs the sound signal to the amplifier 126-1. This delay time is set on the basis of the delay time td2 determined by the delay adjusting unit 155. In this way, the delay adjusting unit 155 adjusts the timing of production of the sound of a hitting sound signal. That is, the delay adjusting unit 155 adjusts a relative relationship between the timing of production of the sound of a string striking sound signal and the timing of production of the sound of a hitting sound signal.

The amplifier 126-1 amplifies the sound signal according to a set amplification factor and outputs the sound signal to the waveform synthesizing unit 1112. This amplification factor is determined on the basis of the hitting sound volume estimated value CV determined by the hitting sound volume adjusting unit 142. Therefore, a hitting sound signal is generated so that the higher the hitting estimated velocity CS calculated according to the depression of a key 70 is, the higher the output level (sound volume) becomes. In this way, the hitting sound volume adjusting unit 142 adjusts the output level of a hitting sound signal on the basis of the hitting estimated velocity CS.

In the case illustrated, j=1 (j=1 to m), and every time the next key depression occurs during the readout of the hitting sound waveform data CW-1 from the waveform readout unit 121-1, control signals obtained from the control signal generating unit 105 are applied in the order of j=2, 3, 4, . . . . For example, with the next key depression, a control signal is applied to a configuration in which j=2, and a sound signal is outputted from the waveform readout unit 121-2 in a manner similar to that described above. This sound signal is delayed by the delay device 115-2, amplified by the amplifier 116-2, and outputted to the waveform synthesizing unit 1112.

[3-6-3. Waveform Synthesizing Unit]

The waveform synthesizing unit 1112 combines a string striking sound signal that is outputted from the string striking sound signal generating unit 1100 and a hitting sound signal that is outputted from the hitting sound signal generating unit 1200 and outputs them to the output unit 180.

The foregoing has described the configuration of the sound source 80.

[4. Setting Process]

Figure 11:
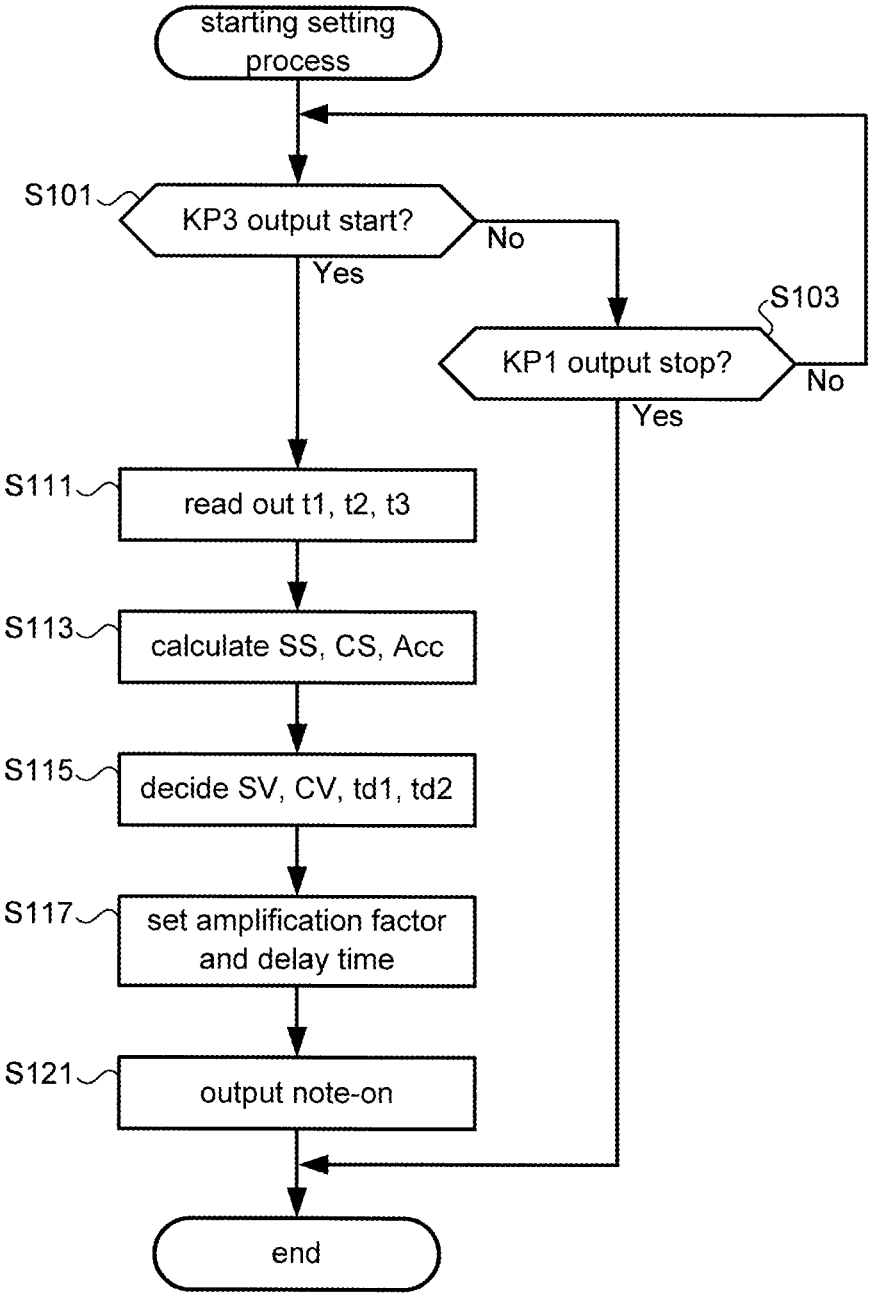
FIG. 11 is a flow chart explaining a setting process according to the embodiment of the present invention.

The following describes, with reference to FIG. 11, a process (setting process) for starting the readout of waveform data by the waveform readout units 111 and 121 by setting parameters into the delay devices 115 and 125 and the amplifiers 116 and 126 in the sound source 80.

FIG. 11 is a flow chart explaining a setting process according to the embodiment of the present invention. The setting process is a process that is executed for each key number KC and, upon output of the first detection signal KP1, is started in correspondence with a key number KC corresponding to the output. First, the sound source 80 waits until the output of the third detection signal KP3 is started or the output of the first detection signal KP1 stops (step S101, No, step S103; No). In a case where the output of the first detection signal KP1 has stopped (step S103; Yes), the setting process ends.

In a case where the output of the third detection signal KP3 has been started (step S101; Yes), the sound source 80 reads out from a memory the point of time t1 at which the output of the first detection signal KP1 was started, the point of time t2 at which the output of the second detection signal KP2 was started, and the point of time t3 at which the output of the third detection signal KP3 was started (step S111). The sound source 80 calculates the string striking estimated velocity SS, the hitting estimated velocity CS, and the acceleration of depression Acc by performing predetermined operations involving the use of the points of time t1, t2, and t3 (step S113). The sound source 80 determines the string striking sound volume designated value SV on the basis of the string striking estimated velocity SS, determines the hitting sound volume designated value CV on the basis of the hitting estimated velocity CS, and determines the delay times td1 and td2 on the basis of the acceleration of depression Acc (step S115).

The sound source 80 sets the amplification factor of the amplifier 116 on the basis of the string striking sound volume designated value SV, sets the amplification factor of the amplifier 126 on the basis of the hitting sound volume designated value CV, sets the delay time of the delay device 115 on the basis of the delay time td1, and sets the delay time of the delay device 125 on the basis of the delay time td2 (step S117). The sound source 80 outputs a note-on Non with respect to a note number Note corresponding to a key number KC (step S121). With this, the setting process ends. This note-on Non triggers the start of the readout of the string striking sound waveform data SW by the waveform readout unit 111 and the start of the readout of the hitting sound waveform data CW by the waveform readout unit 121.

The aforementioned configuration enables the sound source 80 to combine a string striking sound signal and a hitting sound signal and output them as a sound signal. The output level of the string striking sound signal changes according to the string striking estimated velocity SS, and the output level of the hitting sound signal changes according to the hitting estimated velocity CS obtained by an operation method which is different from that by which the string striking estimated velocity SS is obtained. This hitting estimated velocity CS is a value estimated as the velocity of a key 70 at an end position that is a deeper position than the deepest position (third position P3) in which the key 70 can be detected. That is, the hitting estimated velocity CS is equivalent to the velocity at which a keybed hitting sound is produced. Accordingly, the sound source 80 make it possible to reproduce the magnitude of a keybed hitting sound with higher accuracy.

Modifications

In the foregoing, embodiments of the present invention have been described. However, the embodiments may employ embodiments combined or replaced with each other. Further, the embodiments of the present invention may be modified into various forms as below. The modifications to be described below can also be applied in combination with each other.

(1) In the embodiment described above, the hitting estimated velocity CS is an estimate of the velocity of a key 70 at the end position. Alternatively, the hitting estimated velocity CS may be an estimate of the velocity of a key 70 at a deeper position than the third position P3. This makes it possible to reproduce the magnitude of a keybed hitting sound with higher accuracy than by determining the magnitude of a keybed hitting sound according to the velocity of the key 70 at the third position P3. It should be noted that the hitting estimated velocity CS may be calculated according to any operation method, provided the velocity of a key 70 at a deeper position than the third position P3 can be estimated on the basis of a detection signal that is outputted from the key position detecting unit 75.

(2) In the embodiment described above, the string striking velocity calculating unit 131 and the hitting velocity calculating unit 132 both serve to estimate the velocity of a key 70. Alternatively, they may serve to estimate information other than velocity or a value (such as acceleration) pertaining to the behavior of a key 70.

(3) In the embodiment described above, the string striking velocity calculating unit 131 calculates the string striking estimated velocity SS on the basis of the period of time (t2−t1) from passage of the key 70 through the first position P1 to passage of the key 70 through the second position P2. Alternatively, the string striking estimated velocity SS may be calculated by another method. For example, the string striking estimated velocity SS may be calculated on the basis of the period of time (t3−t2) from passage of the key 70 through the second position P2 to passage of the key 70 through the third position P3 or may be calculated on the basis of a period of time (t3−t1) from passage of the key 70 through the first position P1 to passage of the key 70 through the third position P3. Alternatively, the string striking estimated velocity SS may be calculated according to all information on the points of time t1, t2, and t3. That is, the string striking estimated velocity SS needs only be calculated on the basis of a detection signal that is outputted from the key position detecting unit 75.

(4) In the embodiment described above, the hitting sound waveform memory 162 has common hitting sound waveform data CW stored therein regardless of note number. Alternatively, as is the case with the string striking sound waveform data SW stored in the string striking waveform memory 161, different pieces of waveform data may be stored in association with note numbers, or the same waveform data may be associated with at least two note numbers (namely a note number representing a first pitch and a note number representing a second pitch).

Further, in the embodiment described above, the pitch of a hitting sound signal does not change in a case where a note number Note has changed by a predetermined pitch difference (in the case of a switch from an operation of the first key to an operation of the second key). Alternatively, this pitch may change. At this point in time, the pitch of a hitting sound signal may change in a manner similar to the pitch of a string striking sound signal or may change by a smaller pitch difference than a string striking sound signal. Thus, in a case where the note number Note has changed by a predetermined pitch difference, the pitch of a string striking sound signal and the pitch of a hitting sound signal need only be different in magnitude of the change from each other.

(5) In the embodiment described above, a string striking sound signal and a hitting sound signal are generated at different timings. Alternatively, these signals may be generated at the same time.

(6) In the embodiment described above, the sound source 80 generates and combines a string striking sound signal and a hitting sound signal. Alternatively, such a combination does not impose any limitation, provided two types of sound signal are generated and combined.

(7) In the embodiment described above, the sound source 80 generates a string striking sound signal through the use of the string striking sound waveform data SW and generates a hitting sound signal through the use of the hitting sound waveform data CW. Alternatively, a string striking sound signal and a hitting sound signal may be generated by another method. For example, at least either a string striking sound signal or a hitting sound signal may be generated by such a physical model operation as that disclosed in Japanese Patent No. 5664185.

(8) In the embodiment described above, the key position detecting unit 75 detects a key 70 at three positions. Alternatively, the key position detecting unit 75 detects a key 70 at four or more positions. In this case, a position that is deeper than the deepest detection position (toward the end position) needs only be used as the aforementioned fourth position. Further, there may be a case where the position of a key 70 can be continuously detected by optically detecting the position. In this case, three or more positions need only be identified from a detectable range and used in correspondence with the first position P1, the second position P2, and the third position P3. At this point in time, the fourth position may be included in the detectable range, but at least three positions that are shallower than the fourth position are used in an operation.

(9) In the embodiment described above, the keys 70 and the sound source 80 in the electronic keyboard musical instrument 1 are configured as a single musical instrument in the housing 50. Alternatively, the keys 70 and the sound source 80 may be separate components. In this case, the sound source 80 may acquire detection signals from the plurality of sensors of the key position detecting unit 75 via an interface or the like connected to an external device or may acquire the detection signals from data obtained by recording such detection signals on a time-series basis.

REFERENCE SIGNS LIST

1 . . . electronic keyboard musical instrument, 10 . . . control unit, 21 . . . operating unit, 23 . . . display unit, 30 . . . storage unit, 50 . . . housing, 58 . . . keybed,

60 . . . speaker, 75 . . . key position detecting unit, 75-1 . . . first sensor, 75-2 . . . second sensor, 75-3 . . . third sensor, 76 . . . hammer, 78 . . . frame, 80 . . . sound source, 105 . . . control signal generating unit, 110 . . . signal generating unit, 111 . . . waveform readout unit, 112 . . . EV waveform generating unit, 113 . . . multiplier, 115 . . . delay device, 116 . . . amplifier, 121 . . . waveform readout unit, 125 . . . delay device, 126 . . . amplifier, 131 . . . string striking velocity calculating unit, 132 . . . hitting velocity calculating unit, 141 . . . string striking sound volume adjusting unit, 142 . . . hitting sound volume adjusting unit, 150 . . . acceleration calculating unit, 155 . . . delay adjusting unit, 161 . . . string striking sound waveform memory, 162 . . . hitting sound waveform memory, 180 . . . output unit, 706 . . . hammer connecting part, 707 . . . coupling part, 761 . . . key connecting part, 765 . . . spindle, 768 . . . weight, 781 . . . key supporting member, 782 . . . spindle, 785 . . . hammer supporting member, 791 . . . lower limit stopper, 792 . . . upper limit stopper, 800 . . . sound signal generating unit, 1100 . . . string striking sound signal generating unit, 1112 . . . waveform synthesizing unit, 1200 . . . hitting sound signal generating unit

What is claimed is:

1. A sound source comprising:

a memory storing instructions; and a processor that implements the instructions to execute a plurality of tasks, including:

a first calculating task that calculates a first estimated value based on a detection result yielded by a detecting device that detects passage of a key through a first position, a second position, and a third position within a range of depression of the key, the first estimated value pertaining to behavior of the key at a predetermined position within the range of depression, the second position being deeper than the first position, the third position being deeper than the second position;

a second calculating task that calculates a second estimated value based on the detection result, the second estimated value pertaining to behavior of the key at a fourth position that is deeper than the third position;

a signal generating task that generates a first sound signal and a second sound signal based on the detection result;

a first adjusting task that adjusts an output level of the first sound signal based on the first estimated value; and a second adjusting task that adjusts an output level of the second sound signal based on the second estimated value, wherein the first sound signal and the second sound signal represent different sound waveforms, and wherein the output level of each of the first sound signal and the second sound signal is a sound volume.

2. The sound source according to claim 1, wherein the second calculating task calculates the second estimated value based on a first period of time from passage of the key through the first position to passage of the key through the second position and a second period of time from the passage of the key through the second position to passage of the key through the third position.

3. The sound source according to claim 2, wherein the first calculating task calculates the first estimated value based on the first period of time.

4. The sound source according to claim 2, wherein the first calculating task calculates the first estimated value based on the second period of time.

5. The sound source according to claim 1, wherein the first estimated value and the second estimated value correspond to an estimated velocity of the key.

6. The sound source according to claim 1, wherein the fourth position is a deepest position within the range of depression.

7. The sound source according to claim 1, wherein the signal generating task changes a relative relationship between a timing of generation of the first sound signal and a timing of generation of the second sound signal based on the detection result.

8. The sound source according to claim 1, wherein:

the detecting device is provided in correspondence with at least a first key and a second key, and between a first state where the first key has been depressed and a second state where the second key has been depressed, the signal generation task affects a change in a pitch of the first sound signal but does not affect a change in a pitch of the second sound signal or affects a change in the pitch of the second sound signal by a pitch difference that is less than the change in the pitch of the first sound signal.

9. The sound source according to claim 1, wherein the plurality of tasks includes a signal outputting task that outputs an adjusted first sound signal and an adjusted second sound signal.

10. The sound source according to claim 1, wherein each of the different sound waveforms represents a pitch.

11. A keyboard musical instrument comprising:

a detecting device that detects passage of a key through a first position, a second position, and a third position within a range of depression of the key;

a sound source comprising:

a memory storing instructions; and a processor that implements the instructions to execute a plurality of tasks, including:

a first calculating task that calculates a first estimated value based on a detection result yielded by the detecting device, the first estimated value pertaining to behavior of the key at a predetermined position within the range of depression, the second position being deeper than the first position, the third position being deeper than the second position;

a second calculating task that calculates a second estimated value based on the detection result, the second estimated value pertaining to behavior of the key at a fourth position that is deeper than the third position;

a signal generating task that generates a first sound signal and a second sound signal based on the detection result;

a first adjusting task that adjusts an output level of the first sound signal based on the first estimated value; and a second adjusting task that adjusts an output level of the second sound signal based on the second estimated value, wherein the first sound signal and the second sound signal represent different sound waveforms, and wherein the output level of each of the first sound signal and the second sound signal is a sound volume.

12. A method of generating sound signal comprising:

calculating a first estimated value based on a detection result yielded by a detecting device that detects passage of a key through a first position, a second position, and a third position within a range of depression of the key, the first estimated value pertaining to behavior of the key at a predetermined position within the range of depression, the second position being deeper than the first position, the third position being deeper than the second position;

calculating a second estimated value based on the detection result, the second estimated value pertaining to behavior of the key at a fourth position that is deeper than the third position;

setting an amplification factor of a first sound signal based on the first estimated value and an amplification factor of a second sound signal based on the second estimated value; and outputting a signal for starting generation of the first and second sound signals that are to be amplified according to the respective amplification factors, wherein the first sound signal and the second sound signal represent different sound waveforms, and wherein the amplification factor of each of the first sound signal and the second sound signal is a sound volume.

13. The method according to claim 12, wherein the second estimated value is calculated based on a first period of time from passage of the key through the first position to passage of the key through the second position and a second period of time from the passage of the key through the second position to passage of the key through the third position.

14. The method according to claim 13, wherein the first estimated value is calculated based on the first period of time.

15. The method according to claim 13, wherein the first estimated value is calculated based on the second period of time.

16. The method according to claim 12, wherein the first estimated value and the second estimated value correspond to an estimated velocity of the key.

17. The method according to claim 12, wherein the fourth position is a deepest position within the range of depression.

18. The method according to claim 12, wherein a relative relationship between a timing of generation of the first sound signal and a timing of generation of the second sound signal is changed based on the detection result.

19. The method according to claim 12, wherein:

the detecting device is provided in correspondence with at least a first key and a second key, and between a first state where the first key has been depressed and a second state where the second key has been depressed, a pitch of the first sound signal is changed but a pitch of the second sound signal is not changed or the pitch of the second sound signal is changed by a pitch difference that is less than the change in the pitch of the first sound signal.

* * * * *